US005166907A

United States Patent [19]

Newnham et al.

[11] Patent Number: 5,166,907

[45] Date of Patent: Nov. 24, 1992

[54] FREQUENCY AGILE SONIC TRANSDUCER

[75] Inventors: Robert E. Newnham, State College; Qi C. Xu, University Park; Michael Blaszkiewicz, State College, all of Pa.

[73] Assignee: The Pennsylvania Research Corporation, University Park, Pa.

[21] Appl. No.: 720,092

[22] Filed: Jun. 24, 1991

[51] Int. Cl.[5] ..... H04R 17/00

[52] U.S. Cl. ..... 367/157; 367/158; 367/159; 367/162; 310/334; 310/337

[58] Field of Search ..... 367/152, 157, 158, 159, 367/162; 310/322, 334, 337

[56] References Cited

U.S. PATENT DOCUMENTS 4,197,478 4/1980 Silvus, Jr. ..... 310/316
4,633,119 12/1986 Thompson ..... 310/325

OTHER PUBLICATIONS

"Smart Electroceramics", Newnham et al., 1991, pp. 463–480.

"A New Electronic Controlled Suspension Using Piezo-Electric Ceramics", Tsuka et al., IEEE Workshop on Electronic Applications in Transportation, 1990.

"Variable Resonant Frequency Crystal Systems", Fry, W. J., et al., The Journal of the Acoustical Society of America, pp. 94–110, 1951.

"Tunable High-Frequency High-Power Piezoceramic Radiator", E. P. Lanina Sov. Phys. Acoust., 207–209, 1978.

"Biosonar and Neutral Computation in Bats", Suga, N., Scientific American, pp. 60–68, 1990.

"Listening in the Dark: The Voices of Bats", Griffin, D. R., New Haven: Yale University Press, 413 pages, pp. 110–119 included, 1958.

*Primary Examiner*—J. Woodrow Eldred
*Attorney, Agent, or Firm*—Thomas J. Monahan

[57] ABSTRACT

A solid-state tunable transducer has been developed by incorporating an elastically nonlinear material, silicone rubber, into an electroacoustic transducer made from piezoelectric ceramics. The resonant frequency and mechanical Q of the transducer are tuned mechanically by applying a uniaxial compressive stress to the composite. The resonant frequency is tuned electrically by placing a piezoelectric actuator into the composite and varying the magnitude of the d.c. bias.

9 Claims, 8 Drawing Sheets

FREQUENCY AGILE SONIC TRANSDUCER

GOVERNMENT SUPPORT

This invention was made with Government support under Grant N00014-89-J-1689 awarded by the Department of the Navy. The Government has certain rights in this invention.

BACKGROUND OF THE INVENTION

The present invention relates to a tunable transducer. Piezoelectric composite transducer assemblies can be adjusted dynamically with an externally applied signal. Mechanical and electrical adjustment enables operation over a wide frequency band.

By way of background, smart materials sense a change in the environment and, using a feedback system, make a useful response with an actuator. Examples of passively smart and actively smart materials have been described in a recent review paper [Newnhan, R. E., et al., J. Am. Ceram. Soc., 74:463–480 (1991)]. Passively smart materials have self repair mechanisms or standby phenomena that enable the material to withstand a sudden change in the environment. Ceramic varistors and positive temperature coefficient (PTC) thermistors are passively smart materials in which the electrical resistance changes reversibly with voltage (varistor) or temperature (thermistor). When struck by lightning, a zinc oxide varistor exhibits a large decrease in its electrical resistance, and the current is shorted to ground. This change in resistance is reversible. PTC thermistors, such as doped barium titanate ($BaTiO_3$), show a large increase in electrical resistance at the ferroelectric-paraelectric phase transformation (~130° C.). The increase in resistance protects circuit elements against large current surges. Varistors and PTC thermistors function as passively smart materials that use standby mechanisms to prevent electrical breakdown.

Actively smart materials are used in automobile suspension systems to provide controlled compliance for the shock absorber system. The TEMS (Toyota Electronic Modulated Suspension) system [Tsuka, H., et al., *A New Electronic Controlled Suspension Using Piezoelectric Ceramics*, IEEE Workshop on Electronic Applications in Transportation (1990)] uses a piezoelectric sensor to monitor road roughness. The sensor produces a voltage which is amplified in magnitude and altered in phase, and then, applied to a piezoelectric actuator. The actuator produces a hydrostatically enlarged displacement which adjusts the damping force in the shock absorber system. All of these functions, from sensing to hydraulic adjustment, takes place in less than 20 msec.

By introducing a learning function into smart materials, the degree of smartness is upgraded to very smart. A very smart material senses a change in the environment and responds by changing one or more of its property coefficients. Such material can "tune" its sensor and actuator functions in time and space to optimize behavior. With the help of memory elements and a feedback system, a very smart material becomes smarter with age.

The distinction between smart and very smart materials is essentially one between linear and nonlinear properties. This difference can be demonstrated in the behavior of strain with applied electric field in piezoelectric PZT ($PbZr_{0.5}Ti_{0.5}O_3$), and electrostrictive PMN ($PbMg_{0.33}Nb_{0.67}O_3$) ceramics. In hard PZT, the strain is linearly dependent to the applied electric field. Therefore, the piezoelectric $d_{33}$ coefficient, which is equal to the slope of the strain-electric field curve, is constant and cannot be tuned with a bias field. However, PMN ceramics exhibit very large electrostrictive effects in which the strain is proportional to the square of the electric polarization. The nonlinear relation between strain and electric field can be used to tune the $d_{33}$ coefficient. In certain modified PMN ceramics, these values range from zero at a zero bias field to 1500 pC/N at a bias field f 4 kV/cm.

The tunable transducer described herein is an example of a very smart material. Silicone rubber, an elastically nonlinear material, has an adjustable elastic modulus, enabling the transducer to be tuned in frequency and acoustic impedance.

Electromechanical acoustic transducers which employ piezoelectric materials operating at resonance are used as fish finders, biomedical scanners, and sonar systems to search for objects of various sizes. These systems are limited in that the resonant frequency of operation, $f_r$, as well as the mechanical $Q_m$, are fixed and depend on the geometry of the transducer and its complex stiffness. The scattering power of the target depends on the frequency of the interrogating wave and the mismatch in acoustic impedance. It is maximized when the wavelength is approximately the same size as the object. Objects of various sizes can be identified using the same transducer if the resonant frequency can be changed accordingly. By creating a composite transducer whose resonant frequency and mechanical Q can be tuned over a wide range, the versatility of a transducer and its interrogation capabilities can be vastly improved.

The present invention overcomes certain above-described disadvantages inherent with various apparatuses and methods of the prior art. The invention presents a tunable transducer of a very smart material. For example, silicone rubber, an elastically nonlinear material, has an adjustable elastic modulus enabling the transducer to be tuned in frequency and acoustic impedance.

SUMMARY OF THE INVENTION

In accordance with the present invention, tunable transducers of very smart material are described. Transducers of the invention are adjustable with an externally applied signal over a wide range of frequencies, and preferably comprises nonlinear elastic material whose elastic modulus can be manipulated with external force to modulate the resonant frequency over a several decade range.

OBJECTS OF THE INVENTION

An object of this invention is to develop a piezoelectric composite transducer assembly whose frequency can be adjusted dynamically with an externally applied signal.

It is also an object of this invention to develop a transducer assembly having an operating frequency which can be varied in response to received signal patterns to maximize target information.

It is a further object of this invention to develop a tunable transducer incorporating nonlinear elastic material whose elastic modulus can be manipulated with external forces to modulate the resonant frequency over a several decade range. These and other objects and advantages of this invention will become readily apparent from the following description and are particularly delineated in the appended claims.

Advantages of the present invention over the prior are and a better understanding of the invention and its use will become more apparent from the following disclosure in conjunction with the accompanying drawings wherein are set fully by way of illustration and example, certain embodiments of the invention.

TUNABLE TRANSDUCER

Concept

Figure 1:
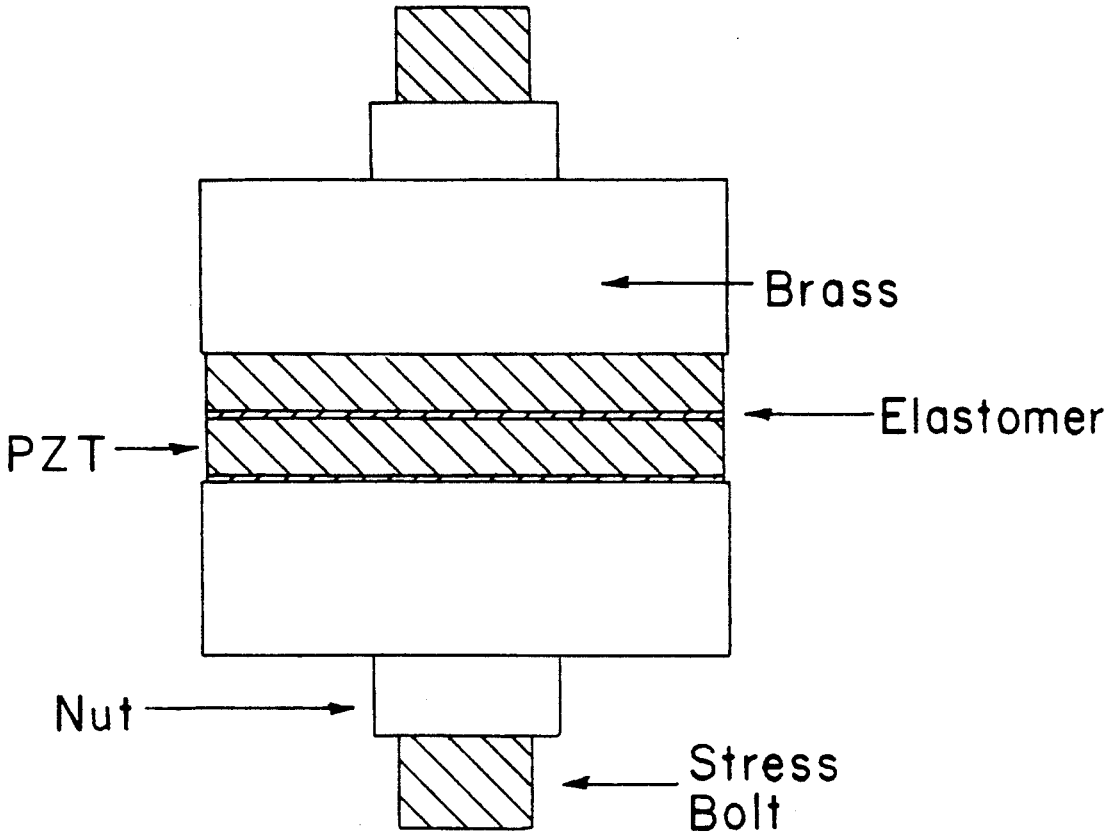
FIG. 1 is a schematic of a composite multilayer transducer.

The resonant frequency of a thickness mode transducer is given by:

$$f_r = \frac{1}{2t}\sqrt{\frac{E}{\rho}} \quad [1]$$

where t is the thickness, E is the elastic modulus, and p is the density. Previous studies of tunable transducers by W. J. Fry, et al., [Fry, W. J., et al., The Journal of the Acoustical Society of America, 23:94–110 (1951)] and E. P. Lanina [Lanina, E. P., Sov. Phys. Acoust., 24:207–209 (1978)] concentrated on varying the resonant frequency by controlling the effective thickness of the transducer. Fry, et al., used a liquid backing media (mercury) which had an adjustable thickness. The object was to produce high intensity ultrasound over a relatively wide and continuous frequency range. This ultrasound was to be projected into a liquid medium. A reduction in the resonant frequency from 80 kHz to 40 kHz was observed as the length of the mercury (and, therefore, the effective thickness of the system) was varied from zero to 2.5 cm.

Lanina described a tunable high-frequency, high-power piezoelectric ceramic radiator for nonlinear acoustic studies. The system was similar to that of Fry, et al., but instead of one piezoelectric ceramic plate and its backing material, the system consisted of two piezoelectric ceramic plates separated by a liquid matching layer, oil. The spacing of the plates was varied between 0.5 and 3 mm. The addition of the second piezo-ceramic plate increased the radiation intensity by a factor of four over that of a single plate. The resonant frequency was varied from 1.7 MHz to 1.9 MHz by changing the thickness of the oil matching layer. Shock waves were produced in a water-filled tank using this device.

According to equation 1, the resonant frequency can also be changed by varying the elastic modulus or the density of the transducer. However, neither of these properties can be easily tuned in piezoelectric ceramics or other standard transducer materials. Therefore, in our design a nonlinear elastic material (rubber) was incorporated into a multilayer composite transducer.

It has been shown that ultrathin (0.01–0.5 mm) rubber-metal laminates possess more pronounced nonlinear behavior of the elastic modulus than ordinary rubber or laminates containing rubber layers 2–4 mm thick. For example, with rubber layers 0.02 mm thick bonded to copper shim 0.08 mm thick, we observed a change in the effective elastic modulus from 6 MPa to 150 MPa under a uniaxial compressive stress of 43 MPa.

The following examples are offered to illustrate particular embodiments of the invention, but are not intended to be limitative thereof.

EXAMPLE 1

Rubber-Metal Laminate

FIG. 1 shows a schematic of the composite multilayer transducer consisting of a rubber-metal laminate sandwiched between two PZT disks and a brass head and tailmass. A stress bolt is used to hold the composite together. In this configuration, the effective elastic modulus of the rubber, and therefore of the composite, can be controlled by tightening the stress bolt to apply a uniaxial compressive stress.

In our initial attempts to control the resonant frequency with uniaxial stress, a layer of silicone rubber (0.4 mm thick) was placed in between two PZT-5 disks. However, the data were not reproducible from one run to the next because the rubber layer was squeezed out from between the PZT and did not contract back into the composite when the stress was decreased. Under high mechanical stress, the rubber was torn and permanently damaged. Similar irreproducible results were obtained with rubber-metal laminates made from silicone rubber and brass shims. The problem in both cases was the inability of the rubber layer to adhere to the PZT or the brass shim. The problem was solved by making a laminate incorporating a specially treated copper shim with a thin coating of polyimide to assist the adhesion with silicon rubber.

The laminate was made in the following way. A silicon rubber-trichloroethylene solution was applied to the polyimide coated side of two pieces of the copper shim cut in the shape of a toroid. This was allowed to set for one hour to let the solvent evaporate. Then the two sides covered with silicone rubber were sandwiched together and placed in a die. This laminate was then hot-pressed at a pressure of 37 MPa and a temperature of 150° C. for one hour. Reproducible behavior of the resonant frequency under applied stress was achieved with these composites.

Mechanical Tuning

Figure 2:
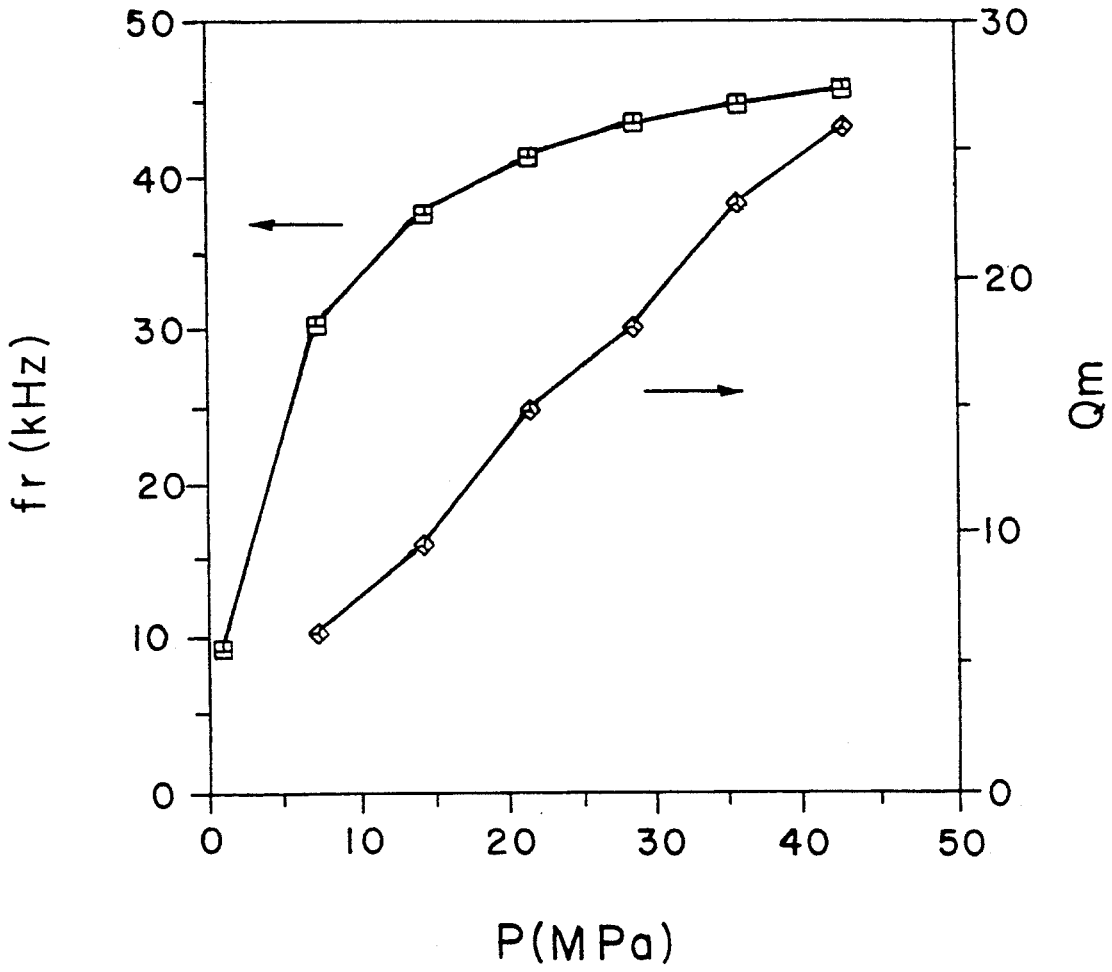
FIG. 2 shows measurements performed by applying unilateral stress to a composite.

The resonant frequency and mechanical Q of the composite transducer can be tuned by applying a mechanical bias (FIG. 2). The measurements in FIG. 2 were performed by applying a uniaxial stress to the composite by tightening the stress bolt with a torque wrench. Then, the resonant frequency of the composite was determined by measuring the conductance as a function of frequency with a Hewlett-Packard 4192A LF impedance analyzer.

EXAMPLE 2

Electrical Tuning

Figure 4:
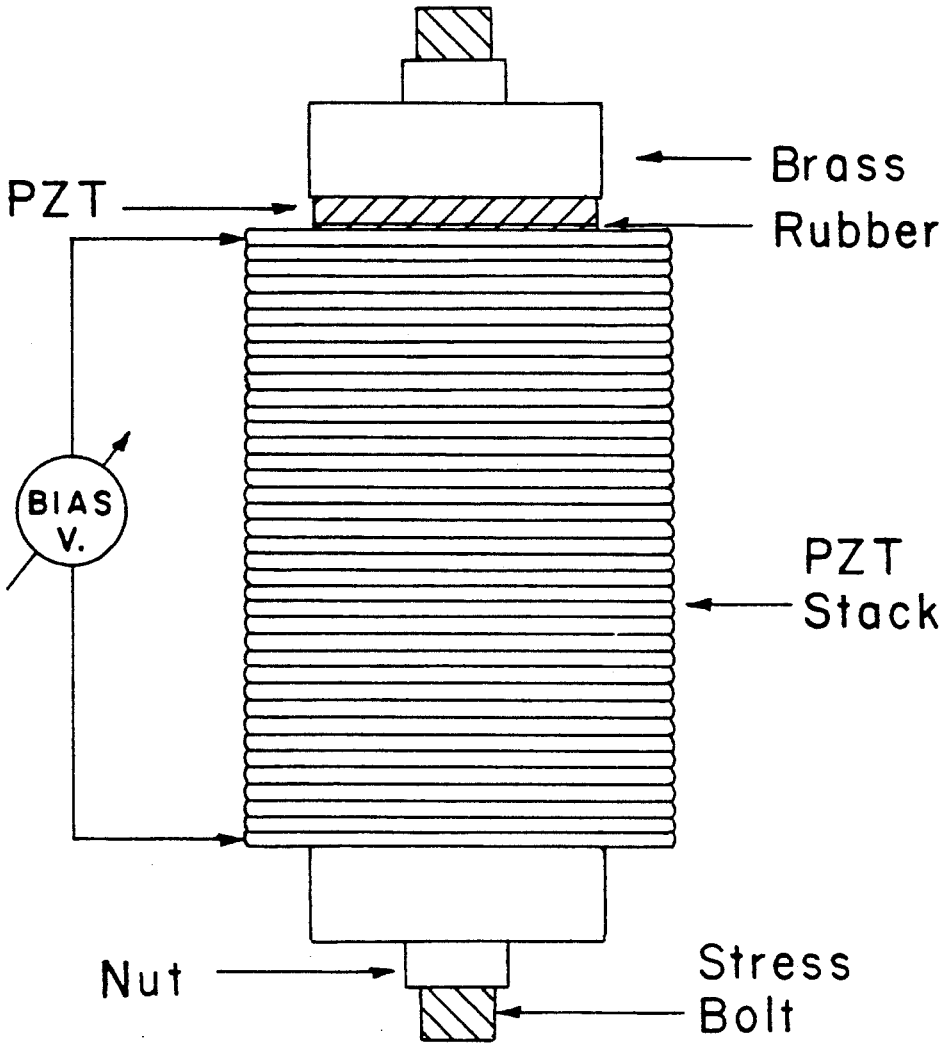
FIG. 4 is a multilayer piezoelectric actuator.

Besides being able to tune the frequency mechanically, it is also possible to tune it electrically. A multilayer piezoelectric actuator made of PZT was incorporated into the composite transducer to produce an additional displacement after a mechanical prestress has been applied (FIG. 4).

Figure 5:
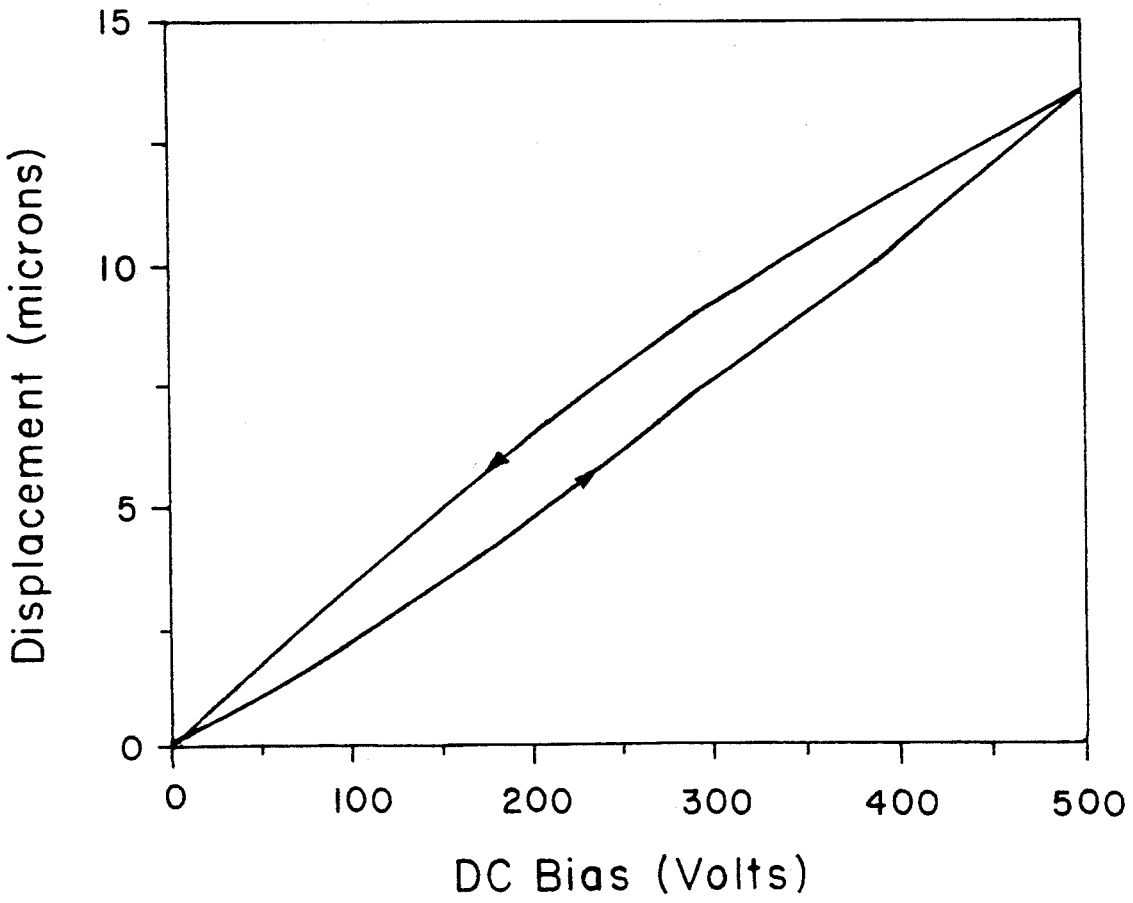
FIG. 5 shows displacement against voltage using a PZT stack of ceramic toroids.

The actuator will expand when a d.c. electric field is applied. A PZT stack of 42 ceramic toroids, each 1 mm thick, produces 10 μm motions (FIG. 5) with 500 volts applied. The displacement is linear with the applied voltage with just a small hysteresis.

Figure 6:
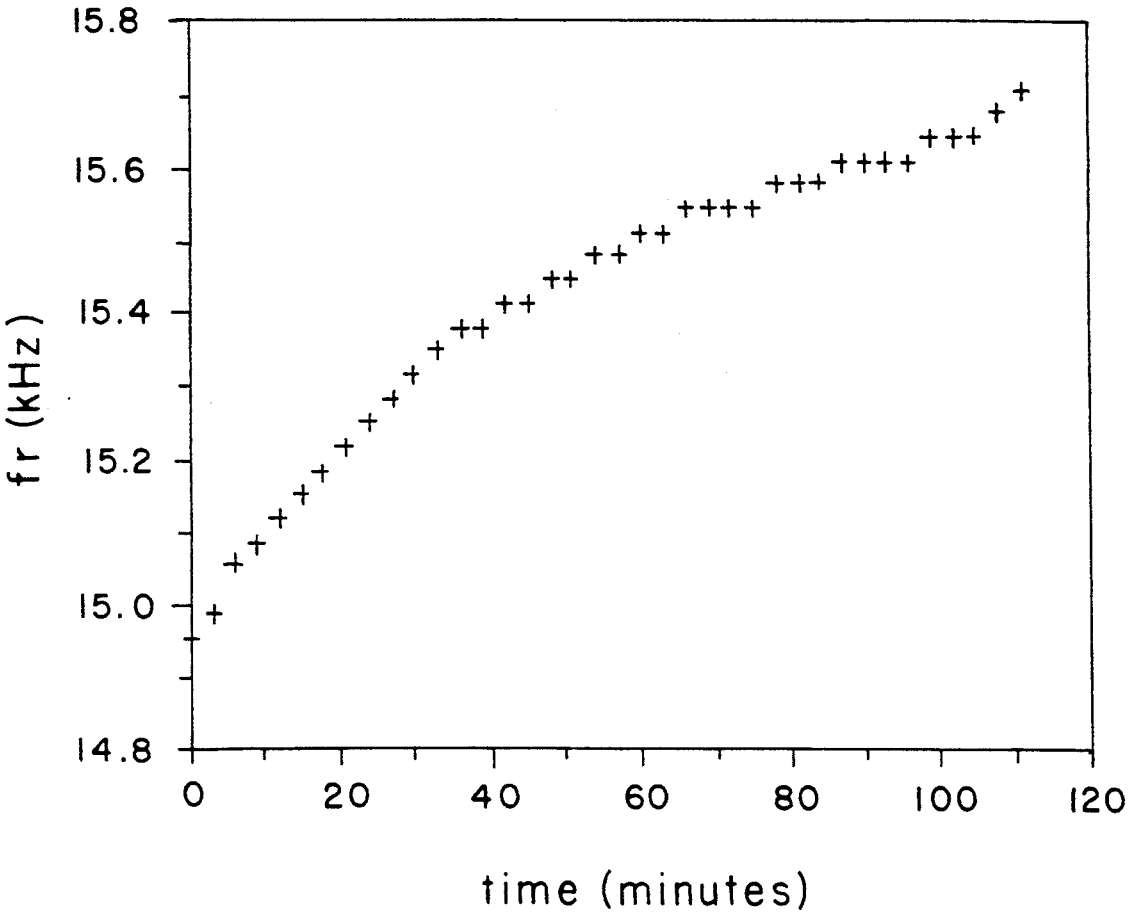
FIG. 6 shows a plot of resonance frequency.

There is a relaxation process that occurs when a mechanical prestress is applied to this composite. It is caused by the epoxy between the toroids in the PZT stack. The epoxy is used to hold the stack together. Initially, the resonant frequency of the composite tends to increase with time because of the hardening of the epoxy in response to the increased mechanical bias. FIG. 6 shows a plot of the resonant frequency as a function of time at a prestress of 7 MPa and no d.c. voltage applied to the PZT stack. Typically, it takes about 12 hours for the resonant frequency to stabilize.

Figure 7:
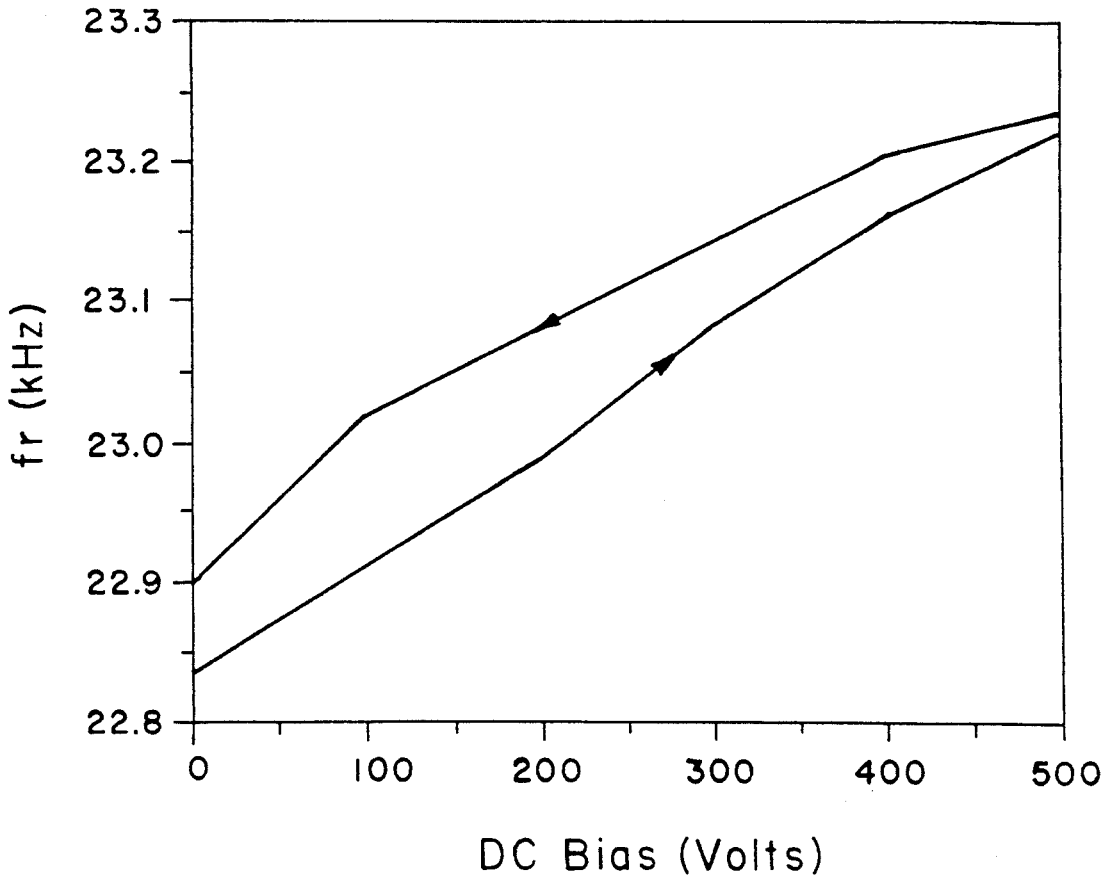
FIG. 7 shows a plot of resonance frequency as a function of voltage applied to a PZT stack.

After the resonant frequency has stabilized, it is possible to tune the frequency using the converse piezoelectric property of the PZT stack. FIG. 7 shows the resonant frequency as a function of the d.c. voltage applied to the PZT stack.

Figure 8:
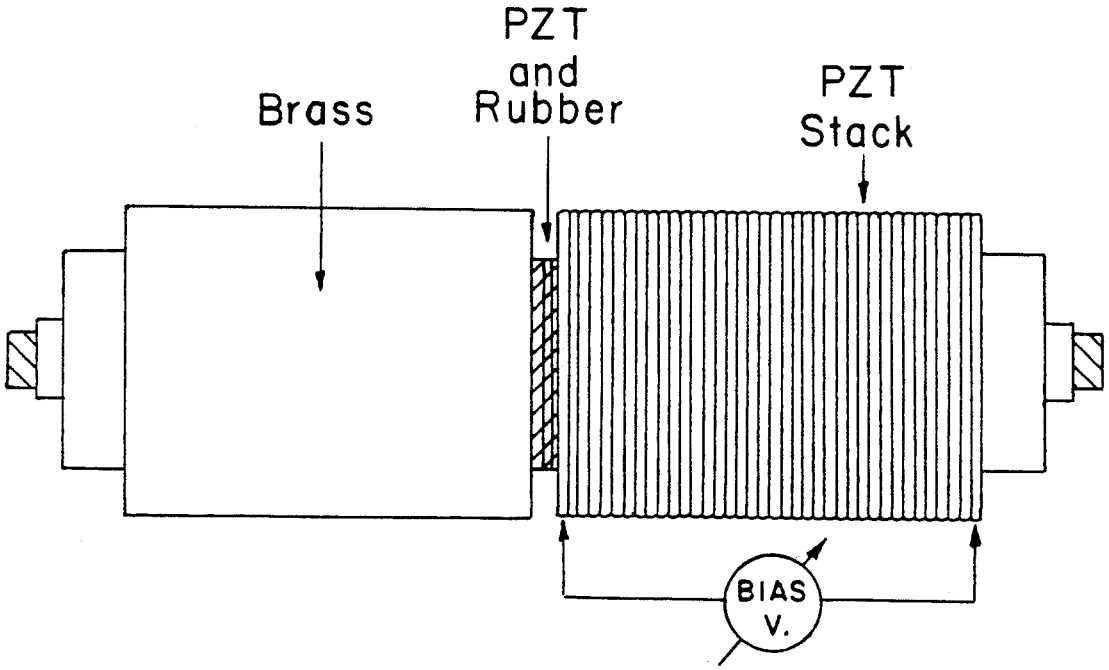
FIG. 8 shows a transducer design.

The reason for the small change in resonant frequency (approximately 350 Hz) was thought to be due to the geometry of the system in that the maximum stress is now approximately at the center of the PZT stack rather than at the rubber-metal laminate. The transducer design was altered to place the maximum stress at the rubber-metal laminate by incorporating a large piece of brass of the same dimensions as the PZT stack. FIG. 8 shows this design.

The resonant frequency change of this modified transducer remained relatively small (330 Hz) for the same pressure and rubber thickness as the previous measurement. The total mass and/or relative thickness of the rubber to the transducer may be the limiting factor in these cases and requires further investigation.

The tunable transducer can be compared with transceiver systems in the biological world. The biosonar system of the flying bat is similar in frequency and tunability to the tunable transducer. The bat emits chirps at 30 kHz and listens for the return signal to locate flying insects. The resonant frequency is modulated by a decrease from 30 kHz to 20 kHz near the end of each chirp [Suga, N., Scientific American, 262: 60–68 (1990)]. Frequency modulation provides superior signal-to-noise ratios and more precise timing of the return signal. The bat modulates the frequency by adjusting the tension applied to the membrane in the larynx generating the chirps. At the beginning of a chirp the muscles apply substantial tension to the membrane. The tension is released at the end of the chirp causing a decrease in frequency. The decrease takes place in milliseconds [Griffin, D. R., Listening in the Dark: The Acoustic Orientation of Bats and Men, New Haven: Yale University Press, 413 (1958)]. We can mimic this frequency modulation in the tunable transducer using an electrically driven screwdriver to tighten the stress bolt. The stress is then released by reversing the operation of the screwdriver in the same way the bat relaxes the muscles that apply tension to the chirp-emitting membrane.

Additional modifications are underway to convert the next generation of very smart materials into intelligent materials. These transducers consist of cermaic thin films, acting as sensors and actuators, deposited on silicon chips. These intelligent materials incorporate sensor and actuator functions with the feedback electronics into an integrated composite transducer.

Modeling the Transducer

Figure 3:
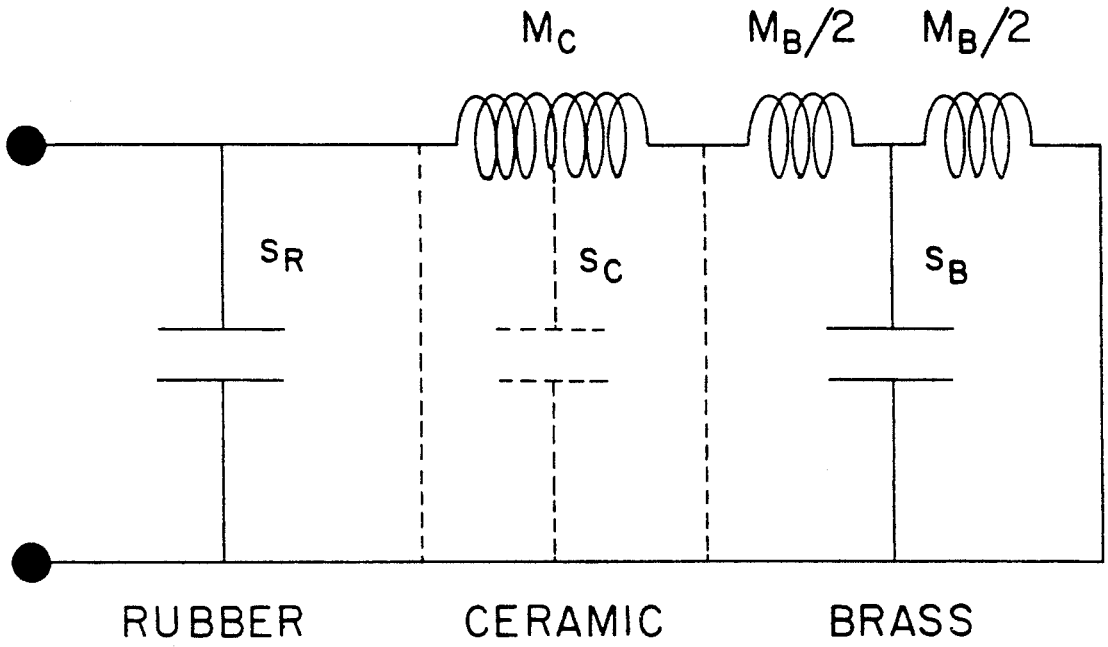
FIG. 3 is a circuit diagram.

The tunable transducer can be modeled using an equivalent circuit shown in FIG. 3. The circuit shows only half the transducer since it is symmetric. The rubber layers are modeled as a spring with zero mass, and the mechanical compliance of the ceramic is neglected. The brass is modeled as having both mass and mechanical compliance. It is further assumed that only the mechanical compliance of the rubber changes appreciably with the application of stress. When the composite is at resonance the mechanical compliance of the rubber is given by:

$$S_R = \left[ \omega^2 M_C + \omega^2 \frac{M_B}{2} + \frac{\omega^2 \frac{M_B}{2}}{1 - \omega^2 \frac{M_B}{2} S_B} \right]^{-1} \quad [2]$$

where w is $2\pi f_r$, $M_C$ is the mass of the ceramic, $M_B$ is the mass of the brass, and $_{SB}$ is the mechanical compliance of the brass.

At very low stress the rubber is very compliant and effectively isolates the upper PZT and brass from the bottom. As the stress increases, so does the mechanical stiffness of the rubber and an additional resonance appears at a frequency much lower than the usual thickness mode with a mechanical Q that is far less than that of the PZT and brass. Both of these effects are caused by the decreased compliance of the rubber and the coupling of the upper and lower parts of the composite. As the rubber stiffens, both the resonant frequency and the mechanical Q increase.

Thus is described our invention and the manner and process of making and using it in such clear, concise, and exact terms so as to enable any person skilled in the art to which it pertains, or with which it is most nearly connected, to make and use the same.

What is claimed is:

1. A piezoelectric composite transducer assembly whose resonant frequency can be adjusted dynamically by an externally applied signal, said transducer comprising:
   - elastic material means having an elastic modulus that is variable in accordance with an applied external force;
   - piezoelectric means;
   - mechanical means for holding said elastic material means and piezoelectric means in compression; and
   - bias means connected to said piezoelectric means for stressing said piezoelectric means and electrically tuning said resonant frequency.

2. The piezoelectric composite transducer assembly of claim 1, wherein said bias means is adapted to apply a range of voltages to said piezoelectric means to vary said electrical tuning.

3. The piezoelectric composite transducer assembly of claim 1, wherein said elastic material means includes silicone rubber.

4. The piezoelectric composite transducer assembly of claim 1 wherein said mechanical means is adjustable to vary compressive forces applied to said piezoelectric means and elastic material means, to further vary said resonant frequency.

5. The piezoelectric composite transducer of claim 1, wherein said elastic material means comprises a composite layer of elastic material rigidly bonded to an inelastic support sheet.

6. The piezoelectric composite transducer of claim 5, wherein said elastic material is silicone rubber and said support sheet includes copper, said support sheet coated with a polyimid to aid in bonding said silicon rubber to said support sheet.

7. The piezoelectric composite transducer of claim 1, wherein said piezoelectric means comprises a stack of piezoelectric ceramic wafers, and a piezoelectric transducer, said bias means connected to said stack of piezoelectric wafers to vary the compressive force exerted on said piezoelectric transducer and elastic material means.

8. The piezoelectric composite transducer of claim 7, wherein said mechanical means comprises a pair of brass blocks that sandwich said piezoelectric means and elastic material means: and means for forcing said brass blocks towards each other so as to create said compressive force.

9. The piezoelectric composite transducer of claim 8 wherein said elastic material means includes silicon rubber and said piezoelectric means comprises PZT ceramics.

* * * * *